US009010229B2

(12) United States Patent
McDonald et al.

(10) Patent No.: US 9,010,229 B2
(45) Date of Patent: Apr. 21, 2015

(54) ARMOUR

(75) Inventors: Jennifer Laura McDonald, Henleaze (GB); David Baker, Street (GB); Amir Rezai, Bradley Stoke (GB)

(73) Assignee: BAE Systems PLC, London (GB)

( * ) Notice: Subject to any disclaimer, the term of this patent is extended or adjusted under 35 U.S.C. 154(b) by 0 days.

(21) Appl. No.: 13/505,690

(22) PCT Filed: Oct. 29, 2010

(86) PCT No.: PCT/GB2010/051816

§ 371 (c)(1), (2), (4) Date: May 2, 2012

(87) PCT Pub. No.: WO2011/051724

PCT Pub. Date: May 5, 2011

(65) Prior Publication Data

US 2012/0216670 A1 Aug. 30, 2012

(30) Foreign Application Priority Data

Nov. 2, 2009 (GB) ..... 0919196.6

(51) Int. Cl.
*F41H 5/04* (2006.01)
*F41H 5/02* (2006.01)

(52) U.S. Cl.
CPC ..... *F41H 5/023* (2013.01); *Y10T 156/10* (2015.01); *F41H 5/0457* (2013.01)

(58) Field of Classification Search
CPC ..... F41H 5/023; F41H 5/04; F41H 5/0414; F41H 5/0428; F41H 5/0435; F41H 5/0442; F41H 5/05; F41H 5/0457; F41H 5/0471; F41H 5/0478; F41H 5/0492
USPC ..... 89/36.02, 903–917
See application file for complete search history.

(56) References Cited

U.S. PATENT DOCUMENTS

| | | | | |
|---|---|---|---|---|
| 8,512,853 | B2 * | 8/2013 | Chakrabarti | 428/223 |
| 2006/0163319 | A1 * | 7/2006 | Ervin et al. | 228/101 |
| 2009/0126557 | A1 | 5/2009 | Hunn | |
| 2009/0208684 | A1 | 8/2009 | Dunleavy et al. | |

(Continued)

FOREIGN PATENT DOCUMENTS

| | | |
|---|---|---|
| GB | 2 054 110 A | 2/1981 |
| GB | 2 283 902 A | 5/1995 |

(Continued)

OTHER PUBLICATIONS

International Search Report (PCT/ISA/210) issued on May 11, 2011, by the European Patent Office as the International Searching Authority for International Application No. PCT/GB2010/051816.

(Continued)

*Primary Examiner* — Bret Hayes
*Assistant Examiner* — Joshua Freeman
(74) *Attorney, Agent, or Firm* — Maine Cernota & Rardin

(57) ABSTRACT

There is disclosed armor having an outer metallic layer, an inner fiber composite layer, and a supporting framework between the inner and outer layers. The supporting framework can include projections from the outer layer arranged to mechanically interlock with the fibers of the fiber composite, and can be arranged to provide an open region between the inner and outer layers that can be filled with a functional filler material.

17 Claims, 3 Drawing Sheets

(56) References Cited

U.S. PATENT DOCUMENTS

| | | | |
|---|---|---|---|
| 2011/0107904 | A1 | 5/2011 | Queheillalt et al. |
| 2011/0272082 | A1 | 11/2011 | Dunleavy et al. |
| 2011/0283873 | A1 | 11/2011 | Wadley et al. |

FOREIGN PATENT DOCUMENTS

| | | | |
|---|---|---|---|
| WO | WO 91/07275 | A1 | 5/1991 |
| WO | WO 2007/003879 | A1 | 1/2007 |
| WO | WO 2007/003880 | A1 | 1/2007 |
| WO | WO 2008/045128 | A2 | 4/2008 |
| WO | WO 2009/048676 | A1 | 4/2009 |
| WO | WO 2009/061539 | A2 | 5/2009 |
| WO | WO 2009/094771 | A1 | 8/2009 |

OTHER PUBLICATIONS

Written Opinion (PCT/ISA/237) issued on May 11, 2011, by the European Patent Office as the International Searching Authority for International Application No. PCT/GB2010/051816.

Annex to Form PCT/ISA/206 Communication Relating to the Results of the Partial International Search Report issued on Feb. 8, 2011, by the European Patent Office as the International Searching Authority for International Application No. PCT/GB2010/051816.

United Kingdom Search Report for GB 0919196.6 dated Feb. 9, 2010.

United Kingdom Search Report for GB 0919196.6 dated Mar. 24, 2010.

Han et al., "Eigen-Image Based Video Segmentation and Indexing" Image Processing, 1997. Proceedings., International Conference on Santa Barbara, CA, USA, (Oct. 26-29, 1997), vol. 2, pp. 538-541, XP010254002.

Notification Concerning Transmittal of International Preliminary Report on Patentability (Forms PCT/IB/326 and PCT/IB/373) and the Written Opinion of the International Searching Authority (Form PCT/ISA/237) issued on May 31, 2012, by the international Bureau of WIPO in corresponding International Application No. PCT/GB2010/051872. (9 pages).

* cited by examiner

ARMOUR

FIELD OF THE INVENTION

This invention concerns improvements relating to armour. In particular, this invention concerns improvements relating to light-weight structural armour for vehicles. It is anticipated that the invention will find application in particular in land vehicles.

BACKGROUND

Armour is used to protect vehicles and their occupants from hostile fire. It is generally desirable for armour to be light, low-cost, and small in size. A number of known armour systems, such as that disclosed in International Patent Application, Publication Number WO2008/045128, make use of layered systems comprising a number of materials and incorporating differing functional components. There exists a general need, however, to improve the functionality of the components of the armour, and to increase the extent to which the different components interact with each other in order to respond appropriately to hostile fire, such as a shock wave and impulse resulting from a nearby explosion, or the impact of a ballistic projectile. There exists a further general need for light-weight armour that is able to efficiently carry both static and kinematic structural loads, so that additional structural components are not necessary.

SUMMARY OF THE INVENTION

In accordance with a first aspect of the invention there is provided armour comprising an outer metallic layer, an inner fibre composite layer, and a supporting structure between the inner and outer layers; the supporting structure comprising projections arranged to penetrate between the fibres of the fibre composite.

The projections may extend at an angle between zero degrees and sixty degrees from the normal to the metallic layer. The projections may be arranged to mechanically interlock with the fibres of the fibre composite. The ends of the projections penetrating the fibre composite may be arranged in a hooked, dove-tailed or capped configuration. The projections preferably only partially penetrate the fibre composite layer. The projections may extend from the outer metallic layer.

The supporting structure may be arranged such that the inner and outer layers are spaced apart. In one exemplary embodiment, a filler material may be incorporated between the inner and outer layers and surrounding the supporting framework. In an alternative embodiment, the armour may be configured such that a filler material can be introduced to, or removed from, the volume between the inner and outer layers.

The supporting structure may comprise a truss structure.

The supporting structure may comprise a number of further projections that are shaped to plastically deform on blast loading of the outer layer. The further projections may be kinked. The further projections may be arranged to mechanically interlock with the fibres of the fibre composite.

The supporting structure may comprise a corrugated metallic structure, in which case the projections may extend from peripheral portions of the corrugated metallic structure into the fibre composite. The supporting structure may alternatively comprise a planar finned structure.

In accordance with a second aspect of the invention there is provided armour comprising an outer metallic layer, an inner fibre composite layer spaced from the outer metallic layer, an open supporting structure between the inner and outer layers arranged such that a core region is defined between said inner and outer layers; and means to enable the core region to be filled or drained with a filler material.

In accordance with a third aspect of the invention there is provided armour comprising an outer metallic layer, an inner fibre composite layer spaced from the outer metallic layer, and an open supporting structure between the inner and outer layers arranged to define a core region between said inner and outer layers; wherein the core region is filled with a filler material.

In accordance with a fourth aspect of the invention there is provided armour comprising a number of metallic layers; a number of fibre composite layers; and a number of supporting structures; the metallic layers alternating with the fibre composite layers, and one of the number of supporting structures being disposed between each metallic layer and the one or more fibre composite layers adjacent to said each metallic layer.

An outer layer is preferably a metallic layer, and an inner layer is preferably a fibre composite layer.

The number of supporting structures may each comprise a number of projections arranged to penetrate between the fibres of one of the number of fibre composite layers. The number of supporting structures may be arranged such that adjacent fibre composite and metallic layers are spaced apart.

The armour may be configured such that a filler material can be introduced to, or removed from, a volume defined between one of the metallic layers and one of the fibre composite layers. A first filler material may be provided in a first volume defined between a first layer of the number of metallic layers and a first layer of the number of fibre composite layers. A second filler material may be provided in a second volume defined between a second layer of the number of metallic layers and a second layer of the number of fibre composite layers.

In accordance with a fifth aspect of the invention there is provided a method of making armour comprising the steps of: providing a metallic layer; providing a supporting structure on the metallic layer, the supporting structure comprising a number of projections; partially embedding the projections into a fibre material; impregnating the fibre material with a resinous material, and curing the resinous material.

The step of providing a supporting structure may comprise forming the number of projections using an additive layer manufacturing process. The step of providing a supporting structure may comprise forming the number of projections by stud welding or projection welding.

BRIEF DESCRIPTION OF THE DRAWINGS

The invention will now be described by way of examples with reference to the accompanying drawings in which.

DETAILED DESCRIPTION OF EXEMPLARY EMBODIMENTS

Figure 1:
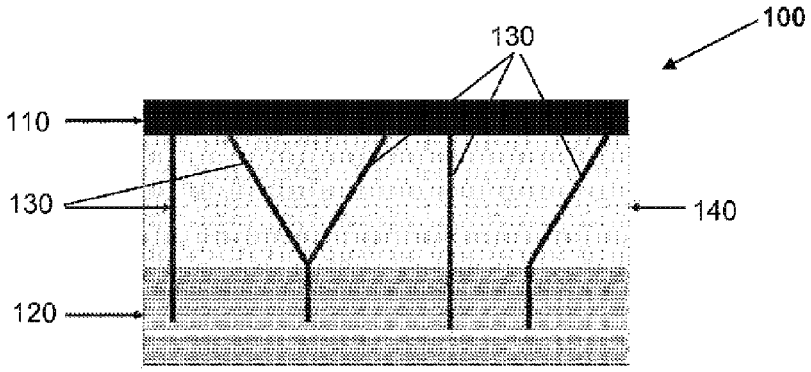
FIGS. 1 (*a*) and (*b*) are, respectively, a schematic cross-section and a perspective view of armour in accordance with a first embodiment of the invention.
Figure 1:
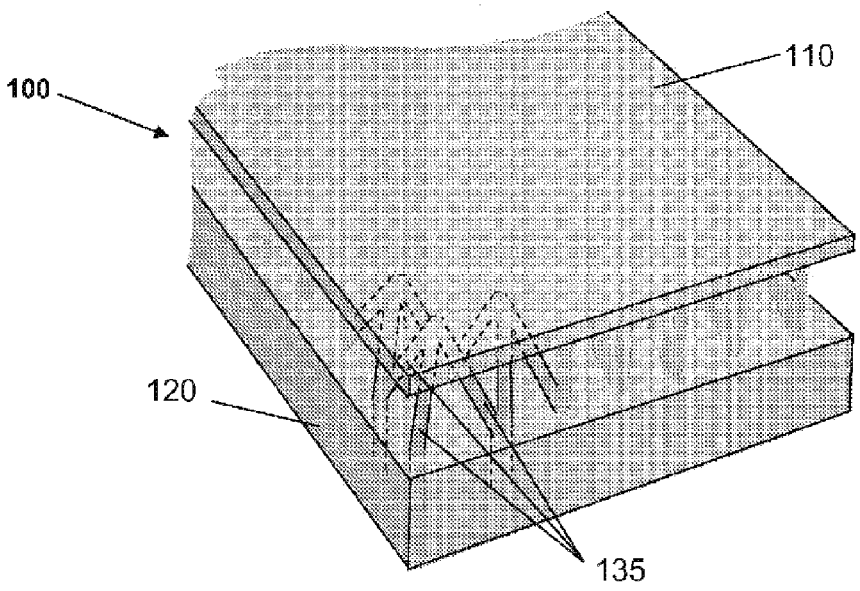

Referring to FIGS. 1 (*a*) and (*b*), there is shown, respectively, a schematic cross-section through, and perspective view of, armour 100 in accordance with a first embodiment of the present invention. Armour 100 comprises a metallic outer layer 110, and an inner fibre composite layer 120. In use of the amour 100 on a vehicle, outer layer 110 provides the outer surface of the vehicle, on which an incident ballistic projectile or blast load will initially impact. Inner layer 120 is spaced apart from the metallic outer layer 110. Inner layer 120 comprises layers of structural fibre or fabric materials that are embedded in a polymer matrix.

A number of projections 130 extend from the outer layer 110, through an intermediate space between inner and outer layers, and into the composite inner layer 120. This intermediate space provides a core region that can be filled as described below in order to enhance selected properties of the armour. The projections 130 are arranged to penetrate between the fibres of the composite layer. It will be noted, however, that the projections do not penetrate entirely through the composite material layer. In an investigation into the strengths of joints between fibre composite materials and metallic materials, this arrangement has been found to result in an improved bond between the fibre composite material and the metallic layer, in comparison to adhesive bonding or mechanical fastening techniques applied in isolation. More particularly, improvements in quasi-static bond strength of greater than 60%, and improvements in energy-to-failure of between 200% and 400% were measured. It is expected, therefore, that the joints between fibre composite and metallic layers in armour 100 will be of similar high quality, and that there will be a high interfacial strength and toughness, although direct characterisation of the armour 100 of the present invention has not yet been performed.

In the present embodiment, the projections 130 form a supporting structure that is a framework in a truss configuration, so that the armour 100 is in the form of a truss-core sandwich structure. The configuration of the supporting structure is most clearly seen in FIG. 1 (*b*). It can be seen that the projections extend from the outer metallic layer 110 in groups of three, each group defining a tetrahedron with its base provided by the fibre composite layer. The projections of one particular exemplary group are labelled with reference numeral 135 in FIG. 1 (*b*). These groups are repeated across the outer metallic layer 110. As is shown in FIG. 1 (*b*), it will be seen that the projections are straight as they extend through the core region of the armour 100, and are then bent so as to penetrate normally into the fibre composite layer 120. Such bends are, however, not essential. Other truss topologies may also may used. For example, projections may be arranged in repeating octahedral units. In general terms, an array of projections extending from the plane defined by the outer layer 110 at an angle to that plane preferably in the range between 90° and 30° may be used. Collapse of the truss core under blast or ballistic loading of the top layer reduces the energy transmitted to the inner composite layer 120, such that the armour is more likely to survive a blast or the impact of a projectile.

Truss structures, comprising, for example, the repeating units of projections described above, are known to be of high specific strength and to exhibit good structural and damage-tolerance properties. As a result, armour 100 has a high strength and good structural properties, and can be used as a structural component in an armoured vehicle, able to withstand both static and kinematic loads. Armour 100 need not, therefore, be added as an additional parasitic component to an existing structure, although it may be desirable to retro-fit an existing vehicle with armour 100 for reasons of improved protection.

The protective effect of armour 100, in the event of blast loading, is due in part to the attenuation of a shock wave progressing through the armour, particularly at interfaces between different layers of the armour where there is a high impedance mismatch, and due to the absorption of the blast energy as a result of the collapse or crushing of the structural sub-elements in the armour. Some prior-known armour systems have been known to fail at the interfaces between different layers of materials: it is expected that, because of the higher strength attachment between the metallic layer and supporting structure and the fibre composite layer that is achieved in the armour 100, such failure mechanisms will be mitigated. Moreover, a strong bond between the various layers results in enhanced interaction between the different components of the armour in comparison to known armour.

A filler material 140 is provided between the inner and outer layers of the armour 100. Filler material 140 surrounds the projections 130 in the core region defined in the space between the inner and outer layers. Whilst the use of a filler material may reduce the impedance mismatch presented to a progressing shock wave at the interface between the outer layer and the core region defined between the inner and outer layers, inclusion of a filler material advantageously provides some reinforcement to the supporting structure provided by the truss framework. Moreover, the use of a filler material enables some control of the deformation threshold of the truss features, whilst the filler material 140 can be selected to display additional crushing, or other, modes of energy absorption. This reduces the amount of energy transferred to the inner fibre composite layer. The use of a filler material selected to display, for example, crushing modes of energy absorption, reduces the risk that the structure will become too rigid and transfer damage to more critical material layers further inside the armour. This is in contrast with the use of reinforcement to the truss structure itself, for example by strengthening the individual projections 130 to increase the deformation or buckling threshold of the truss structure, In the present embodiment, ceramic silicon carbide, formed as an open-cell foamed material is used as the filler material. Such materials are commercially available, for example from the ERG Materials and Aerospace Corporation, of 900 Stanford Avenue, Oakland, Calif. 94608, USA. Ceramic materials are used in armour in order to disrupt high speed projectiles, and to absorb the energy of ballistic impact through brittle fracture processes. Moreover, the high hardness of ceramic materials can deform and erode incident projectiles. Impact of a projectile on ceramic material armour in such a way can generate high velocity fragments of the armour or the projectile, however. Such fragments can cause further damage to the vehicle, or penetrate into an occupied part of the vehicle. Spall liners are commonly used in order to catch such fragments. In the present embodiment, inner composite layer 120 functions as a spall liner, and no additional parasitic layers are necessary. For this reason, it is also advantageous for projections 130 not to penetrate entirely through the composite layer 120. This reduces the risk of the projections themselves detaching from the outer layer 110, as a result of hostile fire, and forming secondary projectiles.

Outer layer 110 is fabricated from rolled homogenous armour material. Rolled homogenous steel armour plate is available in a number of different types as are defined in Def Stan 95-24/3 available at http://www.dstan.mod.uk/data/95/024/00000300.pdf, and is commonly used as an armour material. Rolled homogenous armour steels are selected for properties such as high strength, stiffness and toughness; weldability and resistance to wear. Processes for their manufacture are well known and can be tailored in order to enhance one or more of these properties. In the present embodiment, Armox® 370T Class 1 is used. Armox® 370 T is commercially available from SSAB Oxelösund AB, 613 80 Oxelösund, Sweden, and further details of its composition and properties are available in the technical datasheet that can be downloaded from the manufacturer's website http://www.ssab.com/Global/ARMOX/Datasheets/en/371 ARMOX 370T Class 1 UK Data%20Sheet.pdf.

Projections 130 are formed directly onto the metallic outer layer, in the present embodiment, by an additive layer manufacture process. In this process a powder material is directed as a jet from a nozzle onto a region on a substrate, and consolidated as it is deposited by a laser beam directed to that region. Projections 130 are inserted into fibre material before the matrix component of the fibre composite is cured. In the present embodiment, the fibre composite layer is formed from S2 glass fibres arranged as a woven fabric in a polymer matrix of epoxy resin. The projections 130 are inserted into the fibre material before the matrix component of the composite is cured. In this way, the effect of the projections on the integrity of the fibre composite is reduced, since no machining is required post-curing, and fibre-breakage as a result of insertion of the projections is minimised. Insertion of the projections can be accomplished either before the resin component is added to the fabric or fabric pre-impregnated with uncured matrix material can be used. Such composite materials are readily commercially available.

It is preferred that the inner layer is of a thickness in the range between 6 mm and 30 mm, and that the outer layer 110 is of a thickness in the range between 1 mm and 6 mm. In the present embodiment, the inner layer is of a thickness 15 mm, and the outer layer is 3 mm thick. It is preferred that the space between the inner and outer layers is of a thickness in the range between 5 mm and 150 mm. In the present embodiment, this intermediate space is 30 mm thick, and the projections that extend through the intermediate space are of an approximately cylindrical shape, having a diameter of approximately 3 mm. It is envisaged that such cylindrical projections having a diameter in the range between 1 mm and 6 mm may be used, but it will be appreciated that a large number of shapes and configurations of projection may also be used, dependent upon the strength and weight of the armour necessary for a particular application.

Figure 2:
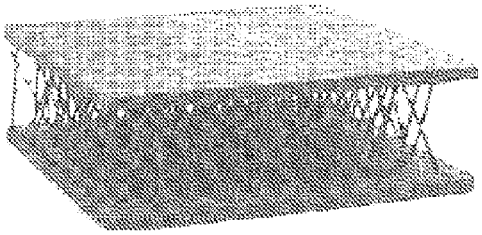
FIG. 2 is a photographic illustration of a truss-core sandwich structure.

It will be appreciated that a number of different configurations could be used for the truss framework of projections in the above described armour 100. For example, the spacing of the repeating units may be varied, but it will be appreciated that many other geometries of truss configurations could also be used. A further alternative exemplary truss configuration, which could be applied in armour 100, is illustrated in FIG. 2.

Figure 3:
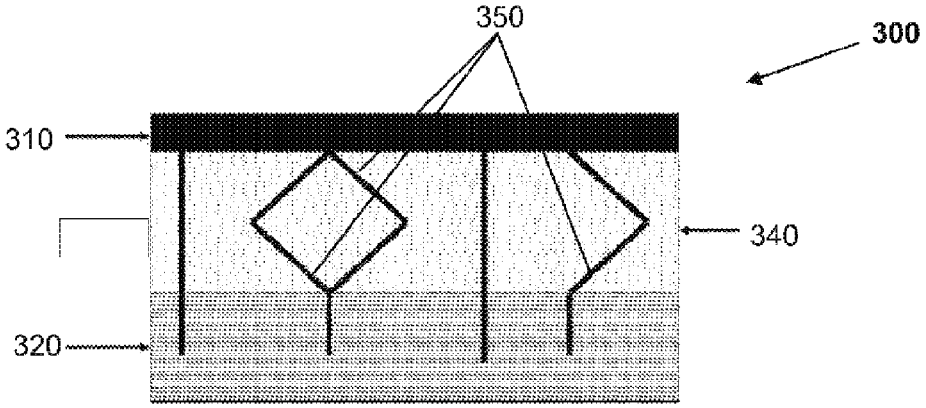
FIG. 3 is a schematic cross-section of armour in accordance with a second embodiment of the invention.

A schematic cross section through armour 300 in accordance with a second embodiment of the invention is shown in FIG. 3. Armour 300 is similar to armour 100 described above, except in that the shape of some of the projections is altered. Like components to those illustrated in FIG. 1 are given like reference numerals, incremented by 200, and are not described further. In armour 300, projections 350 are provided. Projections 350 are shaped so as to plastically deform on loading of the outer layer 310. As illustrated, projections 350 are kinked. Other similar shaped projections are envisaged: for example, it is envisaged to increase the number of kinks provided so that a zig-zag, spring-like projection might be formed. Helical projections may also be used. Projections shaped in such a way are intended to increase the amount of energy absorbed by the armour on blast loading, or on impact of a projectile, by plastically deforming. The shape of the projections can be used to tailor the collapse mechanisms of the armour, for example by increasing the degree to which the projections are kinked or the number of kinks provided in a spring-like structure. Other non-straight configurations of projections can also be used. Such non-straight projections may reduce the structural efficiency of the armour, but, by absorbing additional energy in the event of blast loading or ballistic impact, are expected to increase survivability.

Figure 4:
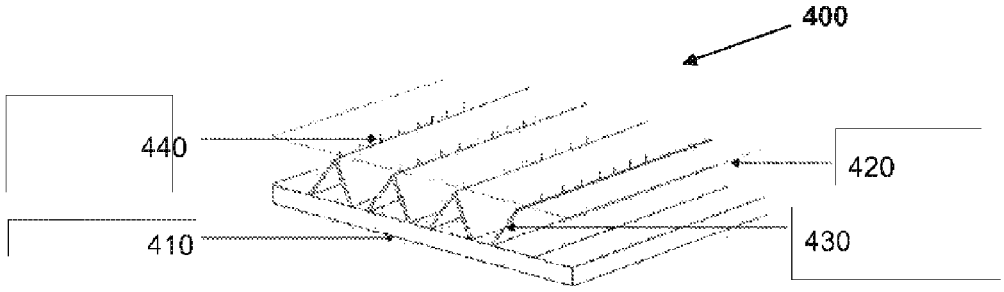
FIG. 4 is a schematic illustration of armour in accordance with a third embodiment of the invention.

FIG. 4 is a schematic illustration of armour 400 in accordance with a third embodiment of the invention. As described above with reference to armour 100, armour 400 comprises an outer metallic layer 410, and an inner fibre composite layer 420. The inner and outer layers are spaced apart by a corrugated metallic structure 430 that fulfils the same function as the truss core described above with reference to armour 100. In order to achieve a strong bond between the corrugated structure and the composite inner layer, projections 440 are formed on the outer portions of the corrugations in order to penetrate between the fibres of the fibre composite. The inner and outer layers are fabricated from materials as described above with respect to the first embodiment of the invention. Projections 440 can be formed using additive layer manufacture, as described above, or may be fabricated using stud-welding techniques. It is expected that armour 400 will be simpler to manufacture than armour 100 and armour 200 described above.

Figure 5:
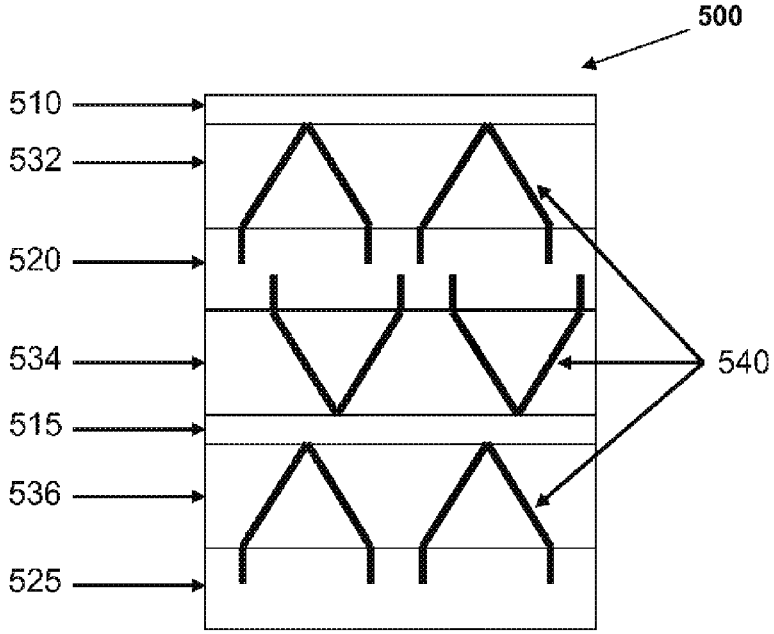
FIG. 5 is a schematic illustration of armour in accordance with a fourth embodiment of the invention.

Armour 500 in accordance with a fourth embodiment of the invention is illustrated in FIG. 5. Armour 500 is a layered system comprising an outer metallic layer 510 that is separated from an intermediate fibre composite layer 520 by filler layer 532. Intermediate fibre composite layer 520 is separated from an intermediate metallic layer 515 by a further filler layer 534. Intermediate metallic layer 515 is separated from inner fibre composite layer 525 by a final filler layer 536. Each metallic layer is joined to either one or two adjacent composite layers by projections 540 that are formed directly onto the metallic layers using an additive layer manufacturing process. The projections penetrate between the fibres of the composite layer, similarly to the manner in which the composite and metallic layers are joined in armour 100 described above. As is described above with respect to the first embodiment, the projections 540 are arranged in a truss configuration to improve the strength and structural efficiency of the armour 500. The individual layers can be fabricated from the same materials as those used to fabricate the corresponding layers of the above-described armour 100. Thus, it will be recognised that armour 500 is similar to the first embodiment 100, but comprises further layers of metallic, composite and filler materials, assembled so as to form a structure having three truss-core sandwiches. Individual layers in armour 500 are fabricated from the materials used in the corresponding layers in the first embodiment of the invention as described above.

The layered system of armour 500 provides an improved shear load capacity, through increased shear strength and increased shear stiffness and improved shock dissipation characteristics. Furthermore, the particular collapse mechanisms of the armour can be further tailored through the use of differently shaped projections in each of the different layers of filler material. It can further be tailored through the use of different filler materials in each of the filler layers 532, 534, 536. Alternatively, it may be possible to impart additional functionality to the armour 500 whilst maintaining the enhanced survivability associated with the armour 100 of the first embodiment of the invention described above. This can be accomplished by including functional filler materials in an inner filler layer in order to improve, for example, the thermal management characteristics of the armour. Ceramic material can be included in an outer filler layer in order that the armour maintains the energy absorption mechanisms associated with ceramic materials.

It will be noted that, in each of the above described embodiments, it will be possible to select the filler material used in the core between the inner and outer layers in order to alter the properties of the armour and to tailor the armour system to any one particular mission or threat. Many types of filler material can be used. For example, other metallic or polymeric foams could be used. Other foamed ceramic materials, such as those based, for example, on silicon, silicon nitride, boron carbide, boron nitride, tantalum carbide or zirconium nitride can be used in place of silicon carbide based ceramic materials. Open-celled or closed-cell foams can be used. Where open cell foams are used, it is possible to introduce or remove a fluid into or from the foam so as to further tailor the functionality of the core region, for example by using the core region as a fuel storage space. Alternatively, cellular or granular ceramics; or ceramic pellets or flakes can be used as a filler material. Pellets or flakes can be provided in a close-packed or layered formation in order to reduce the possibility of penetration between the ceramic elements. Alternatively, ceramic elements embedded in an elastomeric matrix can be used. Lightweight aggregate materials used in the building industry, such as the expanded shale lightweight aggregate marketed as Buildex Lightweight Aggregate, may also be used.

Layered filler materials may also be used in the core region. For example, the use of elastomeric layers disposed between metallic or composite layers has been shown in previous armour systems to provide improved blast protection and an improved response to multiple ballistic hits. It is possible to use a similar layered system in the core region of armour in accordance with any of the above described embodiments, the layered system surrounding the elements of the supporting structure. For example, elastomeric layers may be alternated with fibre composite layers, ceramic layers, or metallic layers.

A fifth embodiment of the invention, not shown in the accompanying drawings, is similar to the first embodiment described above except that the armour is configured to enable the filler material to be introduced to, or removed from, the core region between the inner and outer layers of the armour as desired. It is possible to use fluid or powder filler materials, which can be introduced or removed from the core region through, for example, an opening at an edge of the armour panel. Introduction and removal of the filler material can be accomplished simply using the effects of gravity, or by the appropriate application of a positive pressure or vacuum. The properties of armour in accordance with the fifth embodiment of the invention can thus be tailored to a specific mission by changing the filler material. Moreover, the ability to remove the filler material from the armour provides a method of reducing the weight of the armour, and thus the vehicle as a whole, for transit purposes, or for the purposes of increased agility of a platform for a particular mission or training exercise. Enhanced survivability is expected as a result of the improved fastening of the outer metallic layer and support structure to the fibre composite inner layer.

Where fluids are used, it is preferable to incorporate aeration or other particulate matter in the fluid in order to reduce the risk of an incident shock generating a hydrodynamic ram wave within the fluid that may increase the level of damage to the inner armour layer. For example, aerated slurry materials can be used. Such slurry materials can be based on water or oils, including mineral or synthetic oils, and loaded with, for example, hollow glass microspheres, ceramic pellets or flakes. Powder materials, such as sand or ceramic powders, could also be used as filler materials in conjunction with armour in accordance with the fifth embodiment of the invention. Powdered elastomers may also be used. It will be appreciated that, in the present context, the term powder is used to refer to a collection of particles or any shape or size, the particles being sufficiently small in comparison to the spaces between projections in the core region to allow the particles to be easily introduced into, and removed from, the core region.

Introduction and removal of particulate material can also be achieved through the use of a meltable carrier material. Where the carrier material melts at a temperature below that at which properties of the structure as a whole might be damaged, but above those temperatures that might reasonably be encountered in operations, particulate filler material can be introduced into, or removed from, the core region with the carrier material in the liquid phase. The carrier is then allowed to cool and solidify before the armour is used. Such carrier materials may include waxes, such as common paraffin wax and ester wax, or low molecular weight thermoplastics.

It is expected that the above described embodiments of the invention will find application primarily in land vehicles. However, other embodiments of the invention are envisaged to be applicable to naval vessels, including both surface and submersible vehicles. Moreover, whilst it is expected that embodiments of the invention will not be suitable for the cladding of an entire aircraft structure, it is noted that armour in accordance with embodiments of the invention may find application in protecting specific regions of an aircraft, such as the crew compartment, or critical avionics equipment.

Whilst, in the above, it has been described to use S2 glass fibres consolidated in an epoxy resin for the fibre composite material, it will be appreciated that other fibre composites may be used. For example ceramic matrix composites having long or continuous fibres may be used or composites based on carbon fibres or Kevlar fibres. Other matrix materials, such as vinyl ester resin, or phenolic resin, can also be used. Such materials are also readily commercially available. Moreover, whilst it has been described to use composites having woven fibre layers, it will be appreciated that composites in which the fibres are arranged in non woven or unidirectional arrays, or as stitch bonded non-crimp fabrics may also be used to provide the fibre composite layers.

A large number of alternative materials to the above-described rolled homogenous armour may be used to provide the outer metallic layer of the armour described above. For example, other Armox® materials, similar to Armox® 370 T, can be used; and the skilled person will also recognise that materials such as mild steel, aluminium alloys, nickel, nickel alloys, titanium or titanium alloys could also be used.

Those skilled in the art will also appreciate that, whilst in the above it has been described to use a particular additive layer manufacturing technique to fabricate the projections from the outer metal layer, it will also be possible to fabricate the projections using other additive layer manufacturing techniques that enable convenient attachment of the projections to the composite layer. An example of such a technique is when a powder is provided as a flat bed of static powder and is selectively melted and consolidated by the application of a laser. Welding techniques, such as projection welding, stud welding or investment casting techniques may also be used.

The skilled reader will also note that a large number of filler materials can be used in the embodiments described above, and that the exemplary filler materials described in the context of the above embodiments of the invention do not represent an exhaustive list of potential filler materials. Particular filler materials can be chosen dependent upon the particular application for which the armour is intended. The skilled reader will appreciate that filler materials specifically tailored to enhance particular aspects of their performance, for example to enhance their blast mitigation properties, may be selected or that filler materials intended to display a wide variety of additional functionality may be used.

It may also be possible to include additional functionality in the armour described above. For example, it may be desirable to use self-healing fibre composites, in which frangible hollow fibres containing a curable resin material under pressure are used. Such self-repairing composites are described in international patent applications, publication numbers WO2007/003879 and WO2007/003880, the contents of which are incorporated herein by reference. Such curable resin materials may also be supplied through the projections described in respect of the above embodiments, by forming hollow projections, for example in a cylindrical or pipe-shaped configuration, and providing appropriate channels through the metallic layers to communicate with a reservoir of the curable resin material.

It will also be noted that many other configurations of supporting structure could be used in accordance with the present invention. For example, fin structures; three-dimensional Kagome structures; pyramid structures or egg-box shaped structures could be used. Each of these configurations can be arranged to provide sufficient structural support whilst remaining open such that a filler material can be introduced into the core region of the above described embodiments.

Skilled readers will also note that it is possible to fabricate features, such as the above described projections, from a variety of different materials using additive layer manufacturing techniques in order to provide additional mechanisms for the absorption of energy from blast loading of the armour. For example, additive layer manufacturing techniques can be used to deposit different material species or grades sequentially so as to fabricate a feature having changing characteristics along the growth direction. Such a feature may have changing properties, such as density, stiffness, ductility, or strength, or be fabricated from a number of different materials. This enables further tailoring of a truss structure in order, for example, to promote preferential energy absorption or deformation mechanisms. Additive layer manufacturing techniques can be used to deposit, for example, metals, metal alloys, ceramic, and plastics materials. Additional tailoring of the properties of the projections can be achieved in such a manner, so as to enhance the amount of energy absorbed by the armour in the event of blast loading or the impact of a projectile.

Two-stage additive layer manufacturing processes can also be used in order to generate a wider variety of profiles for the projections in the above described embodiments. For example, improved mechanical interlocking between the projections and the fibre composite could be achieved using hook-shaped, capped or dove-tailed projections. Such profiled projections can be achieved by manufacturing a first section of the projections and adding a first fibre composite layer such that the projections penetrate in their entirety through the first composite layer. After curing of the matrix material of the first fibre composite layer, the hook, cap, or dove-tail can be added in a second stage of additive layer manufacture. Following the second stage of the additive layer manufacture, a second layer of composite material is added to the structure, in order to prevent the capped, hooked or dove-tailed projections from forming secondary projectiles on blast or ballistic loading of the armour, as described above.

The invention claimed is:

1. Armour comprising:
an outer metallic layer;
an inner fibre composite layer; and
a supporting structure between the inner and outer layers, the supporting structure comprising projections arranged to penetrate between the fibres of the fibre composite,
wherein the projections are arranged to mechanically interlock with the fibres of the fibre composite, and
wherein ends of the projections penetrating the fibre composite are arranged in a hooked or dove-tailed configuration.

2. Armour as in claim 1, wherein the projections extend at an angle between zero degrees and sixty degrees from a normal to the metallic layer.

3. Armour as in claim 1, wherein the projections only partially penetrate the fibre composite layer.

4. Armour as in claim 1, wherein a filler material is incorporated between the inner and outer layers and surrounding the supporting structure.

5. Armour as in claim 1, configured such that a filler material can be introduced to, or removed from, a volume between the inner and outer layers.

6. Armour as in claim 1, wherein the supporting structure comprises:
a truss structure.

7. Armour as in claim 1, wherein the projections extend from the outer metallic layer.

8. Armour as claim 1, wherein the supporting structure comprises:
a number of further projections that are shaped to plastically deform on blast loading of the outer layer.

9. Armour as in claim 8, wherein the further projections are arranged to mechanically interlock with the fibres of the fibre composite.

10. Armour as in claim 8, wherein the further projections are kinked.

11. Armour as in claim 1, wherein the supporting structure comprises:
a corrugated metallic structure.

12. Armour as in claim 11, wherein the projections extend from peripheral portions of the corrugated metallic structure into the fibre composite.

13. Armour comprising:
an outer metallic layer;
an inner fibre composite layer spaced apart from the outer metallic layer;
an open supporting structure between the inner and outer layers arranged such that a core region is defined between said inner and outer layers; and
means to enable the core region to be filled with or drained of a filler material,
wherein the supporting structure includes projections arranged to mechanically interlock with fibres of the inner fibre composite layer, and
wherein ends of the projections penetrating the inner fibre composite layer are arranged in a hooked or dove-tailed configuration.

14. Armour comprising:
an outer metallic layer;
an inner fibre composite layer spaced from the outer metallic layer; and
an open supporting structure between the inner and outer layers arranged to define a core region between said inner and outer layers, wherein the core region is filled with a filler material, wherein the supporting structure includes projections arranged to mechanically interlock with fibres of the inner fibre composite layer, and wherein ends of the projections penetrating the inner fibre composite are arranged in a hooked or dove-tailed configuration.

15. A method of making armour, comprising:

providing a metallic layer;

providing a supporting structure on the metallic layer, the supporting structure comprising a number of projections;

partially embedding the projections into a fibre material;

impregnating the fibre material with a resinous material; and curing the resinous material such that the projections mechanically interlock with fibres of the fibre material.

16. A method as in claim 15, wherein the providing of a supporting structure comprises:

forming the number of projections using an additive layer manufacturing process.

17. A method as in claim 16, wherein the providing of a supporting structure comprises:

forming the number of projections by stud welding or projection welding.

* * * * *